US008708447B2

(12) United States Patent
Poxon

(10) Patent No.: US 8,708,447 B2
(45) Date of Patent: Apr. 29, 2014

(54) TEMPERATURE MONITORING SYSTEM FOR A MEDIA PREHEATER

(75) Inventor: John Barry Poxon, Stevenage (GB)

(73) Assignee: Xerox Corporation, Norwalk, CT (US)

( * ) Notice: Subject to any disclaimer, the term of this patent is extended or adjusted under 35 U.S.C. 154(b) by 21 days.

(21) Appl. No.: 13/357,008

(22) Filed: Jan. 24, 2012

(65) Prior Publication Data

US 2012/0120167 A1 May 17, 2012

Related U.S. Application Data

(62) Division of application No. 11/804,796, filed on May 21, 2007, now Pat. No. 8,141,975.

(51) Int. Cl.
*B41J 29/38* (2006.01)
*B41J 29/393* (2006.01)
*B41J 2/01* (2006.01)

(52) U.S. Cl.
USPC ..... 347/17; 347/16; 347/19; 347/102

(58) Field of Classification Search
USPC ..... 347/5, 16, 17, 19, 101, 102
See application file for complete search history.

(56) References Cited

U.S. PATENT DOCUMENTS

| | | | | |
|---|---|---|---|---|
| 4,028,118 | A | 6/1977 | Naksuji et al. | |
| 4,421,560 | A | 12/1983 | Kito et al. | |
| 4,983,810 | A | 1/1991 | Balderson | |
| 5,153,411 | A | 10/1992 | Ndebi | |
| 5,253,100 | A | 10/1993 | Yang et al. | |
| 5,426,143 | A | 6/1995 | de Wit et al. | |
| 5,708,525 | A | 1/1998 | Sheridon | |
| 5,724,639 | A | 3/1998 | Tamura et al. | |
| 5,919,404 | A * | 7/1999 | Fujita et al. | 252/583 |
| 5,974,294 | A | 10/1999 | Tange | |
| 5,974,298 | A * | 10/1999 | Urban et al. | 399/401 |
| 6,040,559 | A | 3/2000 | Chou | |
| 6,390,617 | B1 | 5/2002 | Iwao | |
| 6,446,402 | B1 | 9/2002 | Byker et al. | |
| 6,555,794 | B2 | 4/2003 | Leutner et al. | |
| 7,070,518 | B2 | 7/2006 | Kennedy, III | |
| 2002/0056756 | A1 | 5/2002 | Cameron et al. | |
| 2003/0103548 | A1 * | 6/2003 | Prasad et al. | 374/44 |
| 2007/0093983 | A1 | 4/2007 | Chen et al. | |

OTHER PUBLICATIONS

Bjorn, Petter, J. et al., "Performance of an electrochromic window based on polyaniline, prussian blue and tungsten oxide", Solar Energy Materials & Solar Cells 58 (1999), pp. 277-286 (10 pages).

(Continued)

*Primary Examiner* — Alessandro Amari
*Assistant Examiner* — Kendrick Liu
(74) *Attorney, Agent, or Firm* — Maginot, Moore & Beck, LLP

(57) ABSTRACT

A temperature monitoring system for a media heater of an imaging device comprises a temperature indicator overlying a surface of a media heater of an imaging device. The temperature indicator is configured to vary an optical property in response to changes in temperature at the surface of the media heater. The system includes an optical scanner for scanning the temperature indicator to detect the optical quality. The optical scanner is configured to generate a signal corresponding to the detected optical property.

8 Claims, 6 Drawing Sheets

(56) References Cited

OTHER PUBLICATIONS

Guinneton et al., "Optimized Infrared Switching Properties in thermochromic vanadium dioxide thin films: role of deposition process and microstructure," Thin Solid Films, 2006, pp. 287-295 (9 pages).
http://www.azom.com/article.aspx?ArticleID=1197, "Polyaniline—Processing and Applications", Jan. 14, 2002 (6 pages).
Lu et al., "Use of Ionic Liquids for π-Conjugated Polymer Electrochemical Devices," Science, Aug. 9, 2002: vol. 297. No. 5583, pp. 983-987 (5 pages).
Bjorn, Petter J. et al., "Solar Energy Regulation through Electrochromic Windows based on Polyaniline, Prussian Blue, and Tungsten Oxide," Building Physics 2002—6th Nordic Symposium, Session 8: Energy Use 2, 2002 (8 pages).
Towns, Andy, "The heat is on for new colours," JSDC vol. 115 Jul./Aug. 1999, pp. 196-199 (4 pages).

* cited by examiner

TEMPERATURE MONITORING SYSTEM FOR A MEDIA PREHEATER

CLAIM OF PRIORITY

This patent is a divisional application of U.S. patent application Ser. No. 11/804,796, which was filed on May 21, 2007, is entitled "Temperature Monitoring System for a Media Preheater," and which issued as U.S. Pat. No. 8,141,975 on Mar. 27, 2012.

CROSS-REFERENCE TO RELATED APPLICATIONS

Reference is made to commonly-assigned U.S. patent application Ser. No. 11/498,699 entitled "PRINTING ROLL HAVING A CONTROLLABLE HEAT-ABSORBING INTERNAL SURFACE" by Potter et al. filed Aug. 3, 2006, and which issued as U.S. Pat. No. 7,460,822 on Dec. 2, 2008, the entire disclosure of which is expressly incorporated by reference herein.

TECHNICAL FIELD

This disclosure relates generally to ink jet printers that generate images on media sheets, and, more particularly, to heaters used to thermal condition media sheets before transferring the images to media sheets.

BACKGROUND

Ink jet printing systems using an intermediate imaging member are well known. Generally, the printing or imaging member is employed in combination with a print head to generate an image with a marking material, such as ink. The ink is typically applied to an imaging member, such as a drum or belt, by the nozzles of the print head to form an image on the imaging member as it rotates. After the ink is deposited onto the imaging member to form the image, a sheet of print medium is removed from a media supply and fed to a nip between the imaging member and a transfer roller. As the imaging member rotates, the print medium is pulled through the nip and pressed against the deposited image on the imaging member, thereby transferring the image to the print medium.

Efficient transfer of a marking material from an intermediate imaging member to a media sheet is enhanced by heating a media sheet before it is fed into the nip for transfer of the image. Preheating of the recording medium typically prepares the recording medium for receiving ink by driving out excess moisture that can be present in the recording medium. Preheating the medium reduces the amount of time necessary to dry the ink once deposited on the recording medium. Preheating may also reduce paper cockling which can result from excess moisture remaining in the recording medium.

Previously known preheaters typically a metallic support plate to which a pattern of heat traces have been laminated. The support plate is located in the path of the media to engage and heat the media immediately prior to its engagement with the intermediate transfer drum.

One practical challenge in the design of a preheater is maintenance of a consistent, or uniform, temperature at the heating surface of the preheater. Laminating techniques may leave air gaps between the layers and these gaps make uniform heating difficult. Additionally, insufficient bonding between the layers may cause delamination. Entrapped air and insufficient bonding may lead to stress cracks that can limit the heating element's ability to generate heat homogeneously, which tends to create hot and cold spots along the length of the element.

Non-uniform heating of the media may cause the production of the images by the printer to also be non-uniform. For example, uneven drying and shrinkage of the media may affect the quality of the images produced by the printer. Uneven shrinkage causes the paper to buckle in places which may vary the orientation of the media to the image on the intermediate imaging member in the nip. These unpredictable variations in distance and angle reduce print quality.

Previously known systems for monitoring the temperature of a preheater typically involved one or more temperature sensors, such as thermocouples or thermistors, mounted to the support plate and electrically connected to a conventional proportional temperature controller. Thermocouples and thermistors, however, are only capable of detecting the temperature of the preheater at relatively small areas of the plate. In order to detect inconsistencies in temperature along the entire surface area of the preheater, many thermocouples would be needed which greatly increases the hardware cost and complexity of the system.

SUMMARY

In order to address the issues associated with the prior art, a temperature monitoring system has been developed that enables the detection of temperature inconsistencies across a surface of a media heater and that does not require the use of conventional temperature sensors. The temperature monitoring system comprises a temperature indicator overlying a surface of a media heater of an imaging device. The temperature indicator is configured to vary an optical property in response to changes in temperature at the surface of the media heater. The system includes an optical scanner that scans the temperature indicator to detect the optical quality. The optical scanner is configured to generate a signal corresponding to the detected optical property.

The system implements a method of monitoring a temperature of a media heater of an imaging device. The method comprises detecting an optical property of a temperature indicator overlying a surface of a media heater of an imaging device. An optical property is varied by the temperature indicator in response to changes in temperature at the surface of the media heater. A signal is generated that corresponds to the detected optical property of the temperature indicator.

In another embodiment, a media heating system for an imaging device that indicates the an overall condition of a heater is provided. The media heating system comprises a media heater for heating a recording medium in an imaging device. A temperature indicator overlies a surface of the media heater. The temperature indicator is configured to vary an optical property in response to changes in temperature at the surface of the media heater. An optical scanner scans the temperature indicator to detect the optical quality. The optical scanner is configured to generate a signal corresponding to the detected optical property. The system also includes a media heater controller for receiving the signal from the optical scanner and for controlling the temperature at the surface of the media heater in accordance with the signal.

BRIEF DESCRIPTION OF THE DRAWINGS

The foregoing aspects and other features of a fluid transport apparatus and an ink imaging device incorporating a fluid transport apparatus are explained in the following description, taken in connection with the accompanying drawings, wherein.

DETAILED DESCRIPTION

Figure 1:
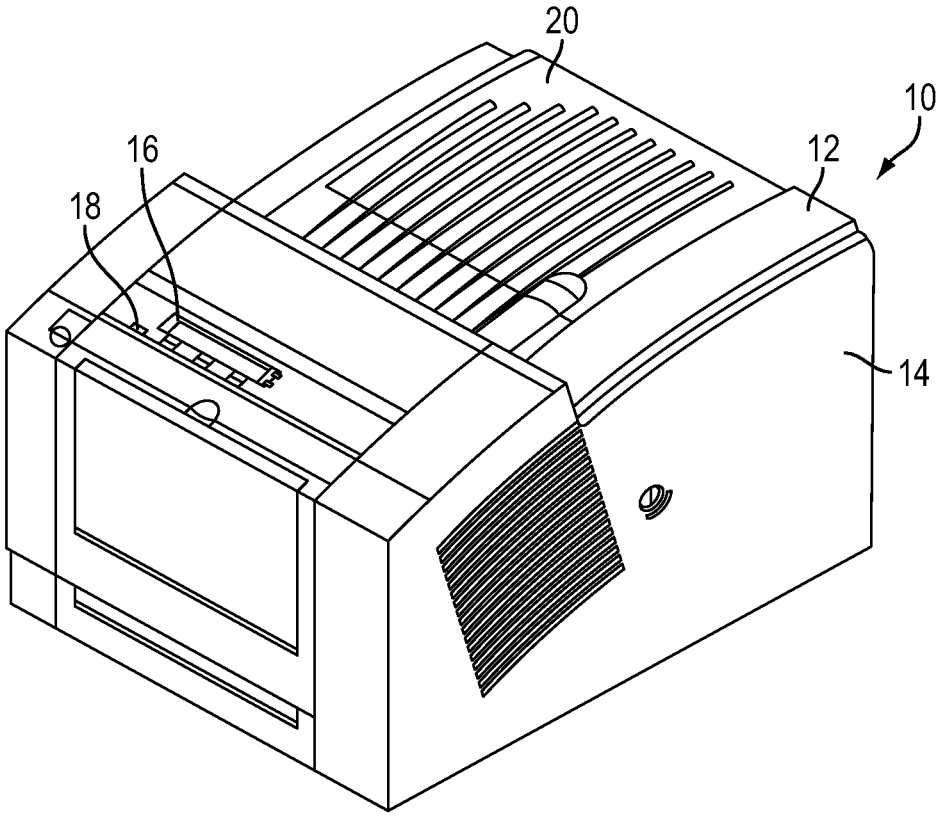
FIG. 1 PRIOR ART
FIG. 1 is a perspective view of a phase change imaging device having a fluid transport apparatus described herein.

For a general understanding of the present embodiments, reference is made to the drawings. In the drawings, like reference numerals have been used throughout to designate like elements.

Referring to FIG. 1, there is shown a perspective view of an ink printer 10 that implements a solid ink print process with an intermediate imaging member. The reader should understand that the embodiment discussed herein may be implemented in many alternate forms and variations and is not limited to solid ink printers only. The system and process described below may be used in image generating devices that operate components at different temperatures and positions to conserve the consumption of energy by the image generating device. Additionally, the principles embodied in the exemplary system and method described herein may be used in devices that generate images directly onto media sheets. In addition, any suitable size, shape or type of elements or materials may be used.

FIG. 1 shows an ink printer 10 that includes an outer housing having a top surface 12 and side surfaces 14. A user interface display, such as a front panel display screen 16, displays information concerning the status of the printer, and user instructions. Buttons 18 or other control elements for controlling operation of the printer are adjacent the user interface window, or may be at other locations on the printer. An ink jet printing mechanism (not shown) is contained inside the housing. An ink feed system delivers ink to the printing mechanism. The ink feed system is contained under the top surface of the printer housing. The top surface of the housing includes a hinged ink access cover 20 that opens as shown in FIG. 2, to provide the user access to the ink feed system.

Figure 2:
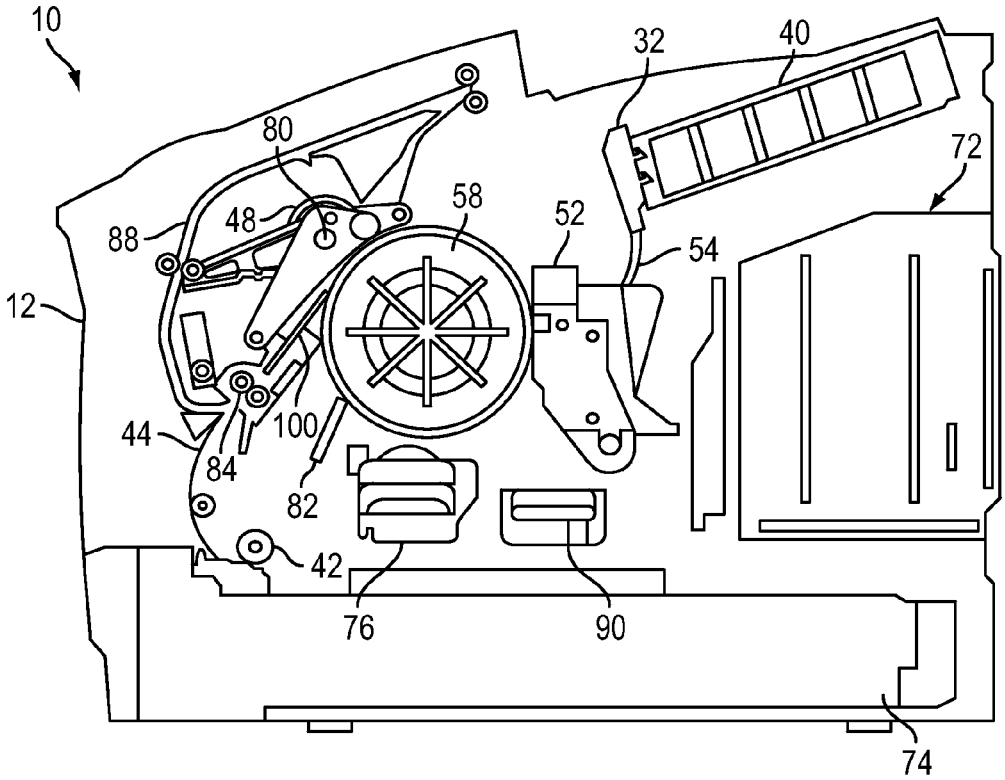
FIG. 2 is an enlarged partial top perspective view of the phase change imaging device of FIG. 1 with the ink access cover open, showing a solid ink stick in position to be loaded into a feed channel.

As shown in FIG. 2, the ink printer 10 may include an ink loading subsystem 40, an electronics module 72, a paper/media tray 74, a print head 52, an intermediate imaging member 58, a drum maintenance subsystem 76, a transfer subsystem 80, a wiper subassembly 82, a paper/media preheater 100, a duplex print path 88, and an ink waste tray 90. In brief, solid ink sticks (not shown) are loaded into ink loader 40 through which they travel to a melt plate 32. At the melt plate 32, the ink stick is melted and the liquid ink is diverted to a reservoir in the print head 52. The ink is ejected by piezoelectric elements through apertures in the printhead to form an image on the intermediate imaging member 58 as the member rotates.

Figure 3:
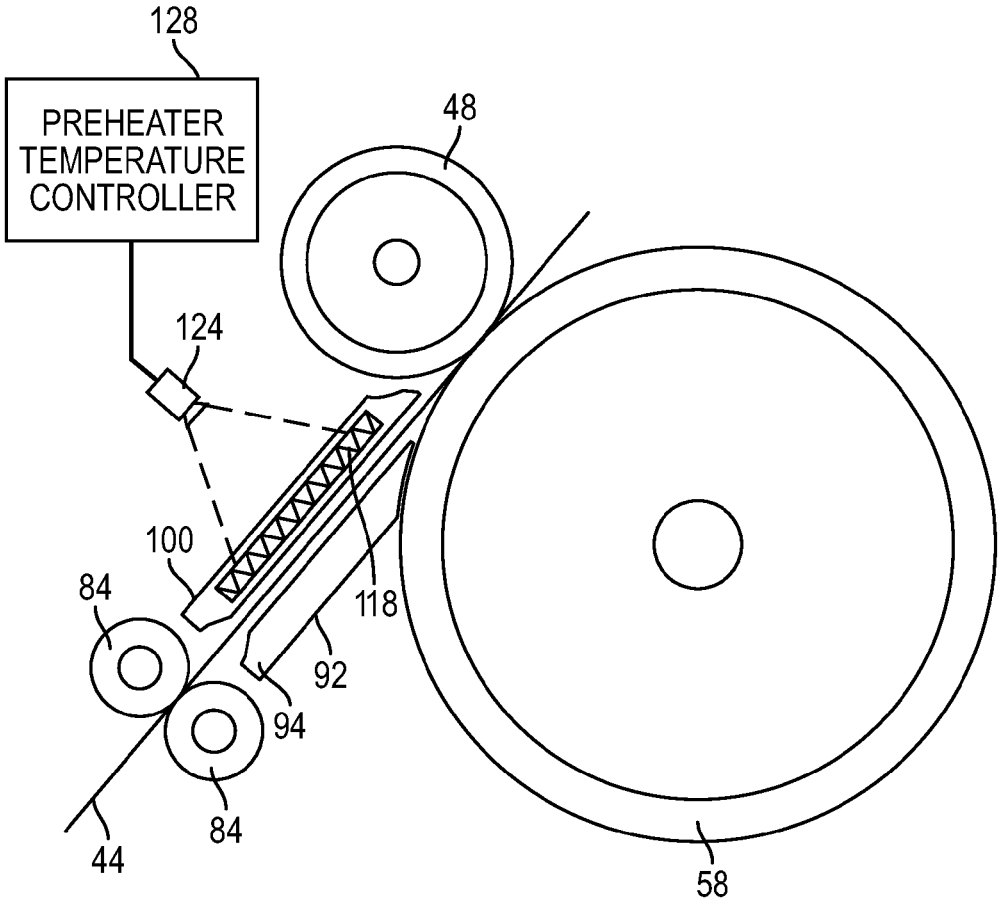
FIG. 3 is a side view of the imaging device shown in FIG. 1 depicting the major subsystems of the ink imaging device.

In synchronization with the generation of images on the intermediate imaging member, a media feed roller 42 delivers print media 44 to a pair of media feed rollers 84. Referring to FIG. 3 and FIG. 2, the feed rollers 84 advance print media 44, such as plain paper or transparency film, into a nip formed between intermediate transfer member 58 and a transfer roller 48 in the transfer subsystem 80. In the embodiment shown in FIGS. 2 and 3, the intermediate image member 58 comprises a rotating drum 58 that provides an intermediate transfer surface upon which images may be printed by the print head 52 (FIG. 2) and transferred to the sheet of printing media 44. The media 44 passes between the drum 58 and transfer roller 48 that is biased against the drum during image transfer. Under the pressure of the transfer roller, the ink is transferred to the media, which is then fed out of the housing 12, while the ink solidifies as it cools.

The preheater assembly 100 may be positioned along the media pathway in order to preheat the print media 44 by the application of thermal energy to the media 44 prior to it entering the nip between the transfer roller and the image drum. The preheating removes excess moisture from the media and may result in more dimensionally stable media as well as improving ink absorption into the media. In this embodiment, the feed rollers 84 advance print media 44 past the preheater 100 and guide plate 92 into the nip formed between intermediate transfer member 58 and a transfer roller 48. The preheater 100 and guide plate 92 are arranged to facilitate the smooth passage of the print media 44 without excessive friction or buckling. The preheater 100 and guide plate 92 may have relatively smooth inner surfaces for allowing a relatively frictionless slide of the media 44 across them. To provide a smooth entry, the preheater 100 and/or guide plate 92 may be flared upwardly away from the media path at the inlet edges 104 and 94, respectively. In an alternative embodiment, the guide plate 92 may be configured as a preheater similar to the preheater 100 so that thermal energy may be imparted to both sides of the media 44 at the same time.

Figure 4:
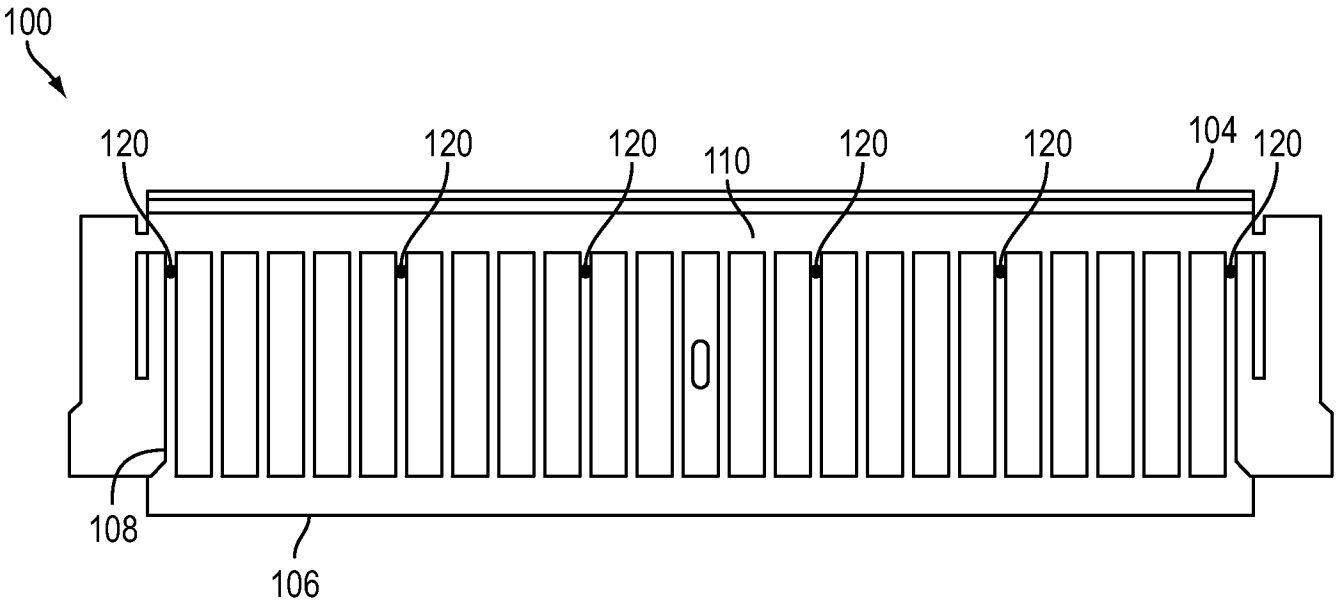
FIG. 4 is an elevational view of a media preheater of the imaging device of FIG. 1.

Referring now to FIG. 4, the preheater 100 may comprise an elongate planar body 108 including an inlet edge 104 and an outlet edge 106. The inlet edge 104 may be configured to be positioned oriented generally along the media pathway to receive print media from the feed rollers 84 as shown in FIG. 3. In one embodiment, the preheater 100 has dimensions of about 61 cm in width between the inlet and outlet edges, 256 mm in length for extending across the media pathway, and 3 mm in thickness. The substantially flat planar construction of the illustrated preheater 100 allows for more surface area to be exposed to the print media 44 as the media moves along the pathway. The dimensions and/or configuration of the preheater, however, may depend on the configuration of the imaging device and the method of feeding the recording media in the device. For example, the media pathway may be curved, in which case, the preheater may be formed with a correspondingly curved surface.

In one embodiment, the preheater 100 is configured to impart enough thermal energy to heat the media to a desired media heating temperature. The media heating temperature may be approximately 60 degrees C., although the media may be preheated to any suitable temperature. The development of thermal energy within the preheater 100 is accomplished through a resistance heating element (not shown) disposed in the preheater. The resistance heating element may comprise a resistance heating wire that includes a pair of termination ends for connecting to the electrical contacts 120 of the carrier assembly. The resistance wire may be an electrically resistive heating conductor composed of alloys that is configured such that heat is produced when electrical power is applied to the electrical contacts 120. One or more thermistors or thermocouples (not shown) may be used to monitor the temperature of the preheater for the proper heating of the medium during normal operation. In addition, the preheater may include thermal fuses (not shown) between the resistance heating element and the electrical contacts 120 for interrupting the supply of power to the resistance heating element in the event of a temperature increase of undesired magnitude.

Power may be provided to the electrical contacts from a power supply (now shown) which may, in turn, be controlled by a preheater temperature controller. Current may be passed from end to end or the heater element length may be bisected by adding intermediate connections. For example, in the embodiment of FIG. 4, the preheater may be divided into heating zones where each zone includes a pair of electrical contacts 120. A resistance heating element may be connected between each pair of contacts 120. Power may be supplied to each pair of contacts separately so that the temperature of the zones may be individually controlled by the temperature controller.

Temperature sensors such as the thermistors or thermocouples are capable of sensing the temperature of only small areas of the surface of the preheater. As an alternative, or in addition to the use of thermistors or thermocouples, the preheater may include a temperature indicating overcoat that overlies at least a portion of the preheater. The temperature indicating overcoat has an optical quality that changes in accordance with the temperature generated by the heating element in the preheater. Thus, the temperature indicating overcoat may indirectly yield information regarding the temperature of the surface area over which the overcoat is located.

As shown in FIG. 3, an optical scanner 124 in operable communication with the preheater temperature controller 128 may be positioned within the imaging device to scan the temperature indicating overcoat to detect the optical quality indicative of the temperature of the preheater 100. The optical scanner 124 may generate one or more signals corresponding to the detected optical quality of the overcoat which may be output to the preheater temperature controller 128. The signals corresponding to the detected optical quality may be used by the temperature controller 128 to generate a temperature profile of the heat generated at the surface of the preheater 100.

Figure 5:
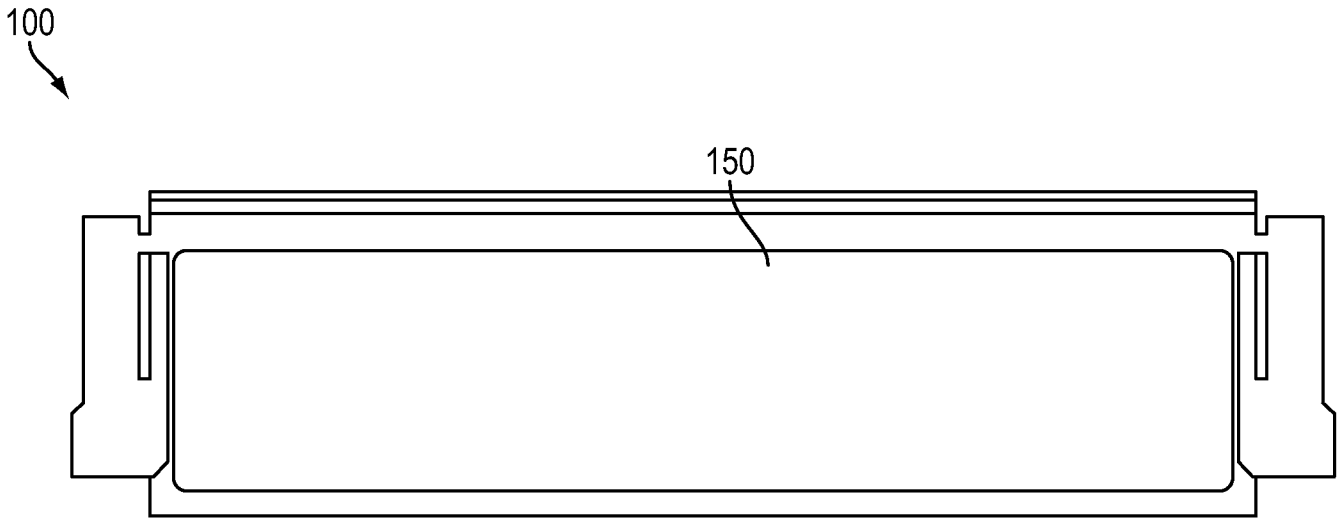
FIG. 5 is an elevational view of the media preheater of FIG. 4 that includes a thermochromic overcoat.
Figure 6:
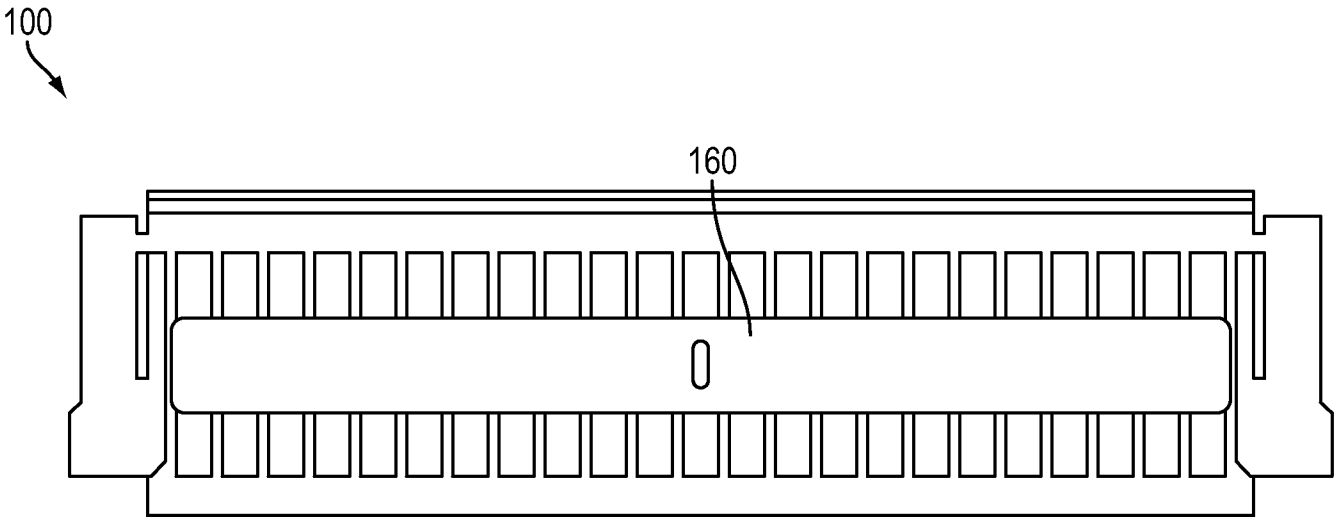
FIG. 6 is an elevational view of the media preheater of FIG. 4 that includes another embodiment of a thermochromic overcoat.

The temperature indicating overcoat may be applied to any surface of the preheater which is accessible to the optical scanner. As shown in FIG. 5, the overcoat 150 may be applied to an entire surface of the preheater. Alternatively, only select portions of a surface may have the thermochromic overcoat. For example, as shown in FIG. 6, an overcoat may be applied in one or more strips 160 that extend laterally across a surface of the preheater. Suitable methods for the application of the thermochromic overcoat include, but are not limited to, dipping, painting, rolling, spraying, stamping, over molding or co-extrusion.

In one embodiment, the temperature indicating overcoat comprises a thermochromic overcoat. Thermochromic materials undergo color changes in response to temperatures at or above an activation temperature. "Color change" is understood in a broad sense to include not only changes in hue, saturation and intensity, but also changes in opacity, and may include for example a change between completely opaque and completely clear. Thus, thermochromic materials may exhibit color changes from "color to transparent," "transparent to color," or from "one color to another color." The capacity to change color may be reversible in the sense that the color of the material returns to its initial color when the temperature returns to its initial, sub-activation level. The characteristic color change generally occurs as the temperature varies over a transition range beginning at the activation temperature. For the purposes of this disclosure, the color change may take place quickly over a narrow transition range or more gradually over a broader transition range.

Thermochromic materials that undergo sharp, reversible visual color changes in response to temperature changes are known in the art, and are typically available in a wide range of activation temperatures and color change characteristics. Thus, the thermochromic materials used in the overcoat may be selected in accordance with a desired color change and/or a desired activation temperature. Examples of thermochromic materials include leuco dye compositions and liquid crystal compositions which may come in a various formulations including inks, paints or other coating compositions. In the embodiments described, the thermochromic overcoat includes one or more thermochromic inks. However, any suitable thermochromic material may be used. Various formulations of thermochromic inks are available from a number of commercial suppliers. One commercial source of thermochromic inks is Craig Adhesives and Coatings Company of Newark, N.J., U.S.A.

In one embodiment, the thermochromic overcoat includes a single thermochromic material for exhibiting a color change at a predetermined activation temperature. The thermochromic material of this embodiment may be selected so that the activation temperature of the material has a predetermined relationship to the desired media heating temperature of the preheater. For example, the activation temperature may be selected so that a color change is exhibited substantially at the media heating temperature or at a predetermined temperature lower than or greater than the media heating temperature. The color change may be from "color to transparent," "transparent to color," or from "one color to another color" so long as the color change is detectable by an optical scanner. The use of a single thermochromic material in the overcoat provides an observable indication regarding the temperature of the preheater with respect to a threshold and the location on the preheater where the threshold was crossed.

In order to enable a more differentiated statement about the heat generated at the surface of a preheater, the thermochromic overcoat may include a plurality of different thermochromic materials having different transition temperatures that each exhibit different color changes when the respective activation temperatures are reached. Thermochromic materials having different activation temperatures may be applied in layers one over the other or may be applied side by side in strips across a surface of the preheater. In the case when thermochromic materials are applied in layers, the materials should be applied and/or selected in a manner so that the color changes of each material are visible or detectable by a scanner. Layered thermochromic materials may be selected so that they exhibit a "transparent to color," or "color to transparent" transition characteristic. Therefore, as the respective activation temperatures of the materials are reached, only the colors of the activated thermochromic materials may be visible. For example, in the "transparent to color" case, thermochromic materials may be layered according to magnitude of the activation temperature such that the materials having the lowest activation temperatures comprise the innermost layers. In the "color to transparent" case, thermochromic materials may be layered such that the materials having the lowest activation temperatures comprise the outermost layers.

The selection of thermochromic materials for the overcoat may be such that the activation temperatures of the plurality of thermochromic materials have an increasing order of magnitude. In such an embodiment, adjacent activation temperatures in order of magnitude may form a temperature range. For example, a thermochromic overcoat may include a first thermochromic material that exhibits a change to a first color at a first activation temperature and a second thermochromic material that exhibits a change to a second color at a second activation temperature that is greater than the first activation temperature. As heat is generated in the preheater, if the thermochromic overcoat exhibits the first color, information that the temperature of the preheater is above the first activation temperature and below the second activation temperature may be derived.

Referring to FIG. 3, the optical scanner 124 is positioned within the imaging device to scan the thermochromic overcoat in order to detect the "color changes" of the overcoat. Any suitable optical scanning system may be used that is capable of periodically scanning the surface of the preheater over which the thermochromic overcoat is disposed and generating output signals corresponding to the color of the overcoat. In one embodiment, the optical scanner 124 includes one or more laser diode arrays (not shown) for emitting light onto the temperature indicating overcoat on the surface of the preheater and a corresponding array of photodetectors (not shown) for detecting the amount of light reflected from the temperature indicating overcoat. The amount of the reflected light, or its intensity, the reflected light corresponds to the color of the overcoat.

In one embodiment, the output of the scanner corresponds to the amount of light reflected from the overcoat on the surface of the preheater. The scanner output may be stored in a data structure, such as a table, in which each entry in the data structure corresponds to the amount of reflected light received by a detector in the scanner from the surface of the preheater. Each time a scanning operation is performed, the intensity or reflectance values in the data structure are updated. The reflectance values are compared in a known manner to one or more reflectance values that correspond to one or more different activation temperatures. The relationships of the measured reflectance values to the reflectance values representing activation temperatures identify a temperature for each detected reflectance value in the data structure.

Using the relationships between the measured values and the activation temperature values, a temperature profile corresponding to the temperature at the surface of the preheater may be generated. The temperature profile may be used in a number of ways by an imaging device. For example, the preheater temperature controller may use the temperature profile to regulate the power supplied to the electrical contacts of the preheater in order to control the heat generated by the preheater. In preheaters having multiple heating zones, temperature differences between zones may be determined from the temperature profile so that the heat generated by each zone may be regulated to maintain temperature uniformity across the preheater. Moreover, a temperature profile enables the detection of hot and cold spots on the preheater. If hot spots or cold spots are detected on the preheater that are above or below a threshold value, imaging operations may be stopped. In addition, an alert message may be displayed to a user on a user interface indicating that service may be required.

Those skilled in the art will recognize that numerous modifications can be made to the specific implementations described above. For example, some embodiments of imaging devices include an optical scanner for inspecting the intermediate transfer member, such as, a transfer drum or belt of the imaging device. Consequently, in an alternative embodiment, the optical scanner for inspecting the transfer member may be configured to periodically scan the overcoat on the preheater. The scanner in this case may be configured to pivot or otherwise be moved into a position in the printer that permits scanning of the overcoat. Moreover, the temperature monitoring system may be used for monitoring the temperature of media heaters disposed at any point in the media pathway including before, during, or after the transfer operation. The preheater may be used to heat media in ink-jet or laser printers using either solid or liquid inks, as well as, electrostatographic imaging devices. Therefore, the following claims are not to be limited to the specific embodiments illustrated and described above. The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others.

What is claimed is:

1. A temperature monitoring system for a media heater of an imaging device, the temperature monitoring system comprising:

a temperature indicator overlying a surface of a media heater of an imaging device, the temperature indicator being configured to vary an optical property in response to changes in temperature at the surface of the media heater;

an optical scanner configured to scan the temperature indicator to detect the optical property of the temperature indicator, the optical scanner being configured to generate a signal corresponding to a temperature of the surface of the media heater with reference to the detected optical property; and a media heater controller configured to receive the signal generated by the optical scanner, calculate a temperature profile of the surface of the media heater with reference to the signal, and control the temperature at the surface of the media heater with reference to the calculated temperature profile.

2. The system of claim 1, the temperature indicator comprising a thermochromic overcoat having at least one thermochromic material that changes color in response to changes in temperature at the surface of the media heater.

3. The system of claim 2, the at least one thermochromic material having an activation temperature, the at least one thermochromic material being configured to change color from a first color to a second color in response to the temperature at the surface of the media heater reaching the activation temperature.

4. The system of claim 3, the thermochromic overcoat comprising a plurality of thermochromic materials, each thermochromic material in the plurality of thermochromic materials having a different activation temperature.

5. The system of claim 4, the optical scanner being configured to detect an amount of light reflected from each thermochromic material in the plurality of themochromic materials, each amount of reflected light corresponding to a color of one thermochromic material in the plurality of thermochromic materials.

6. The system of claim 2, the optical scanner being configured to detect an amount of light reflected from the thermochromic overcoat, the detected amount of reflected light corresponding to the color of the overcoat.

7. The system of claim 6, the signal comprising a plurality of reflected light amounts, each amount of reflected light in the plurality of reflected light amounts corresponding to a different area of the surface of the media heater.

8. The system of claim 2, the thermochromic overcoat comprising a thermochromic ink.

* * * * *